United States Patent [19]

Pryor

[11] Patent Number: 4,688,687

[45] Date of Patent: Aug. 25, 1987

[54] CLOSET STORAGE ARRANGEMENT

[76] Inventor: Nicholas Pryor, 12940 Addison St., Sherman Oaks, Calif. 91423

[21] Appl. No.: 910,318

[22] Filed: Sep. 24, 1986

Related U.S. Application Data

[63] Continuation of Ser. No. 6,795,169, Nov. 5, 1985, abandoned, which is a continuation of Ser. No. 6,366,536, Apr. 8, 1982, abandoned.

[51] Int. Cl.[4] ..... A47F 5/00

[52] U.S. Cl. ..... 211/189; 211/34; 211/37; 211/123

[58] Field of Search ..... 211/34, 37, 35, 86, 211/123, 105.1, 189, 32, 87

[56] References Cited

U.S. PATENT DOCUMENTS

| | | | |
|---|---|---|---|
| 1,733,487 | 10/1929 | Hackley . | |
| 3,538,842 | 11/1970 | Labbato . | |
| 3,913,745 | 10/1975 | Weiss | 211/34 |
| 4,209,099 | 6/1980 | Wicker | 211/182 |

FOREIGN PATENT DOCUMENTS

| | | | |
|---|---|---|---|
| 1206143 | 8/1959 | France | 211/37 |
| 195888 | 10/1964 | Sweden | 211/206 |
| 678852 | 9/1952 | United Kingdom | 211/34 |

*Primary Examiner*—Robert W. Gibson, Jr.
*Attorney, Agent, or Firm*—Burns, Doane, Swecker & Mathis

[57] ABSTRACT

A closet storage arrangement for increasing closet storage capacity includes a shoe case having two vertical side walls with a plurality of vertically spaced tiers for shoe storage provided in the case. Each tier has three horizontal shoe support members on which a shoe is rested. A clothes hang bar for supporting clothing may also be provided with the hang bar secured on each end in a vertical support member. Each vertical support member is stabilized against the back wall of the closet by a stabilizing arrangement. A shelf may be supported by the vertical support members. A peg bar, having selectively removable pegs, for hanging articles may also be provided in the closet.

7 Claims, 5 Drawing Figures

CLOSET STORAGE ARRANGEMENT

This application is a continuation of application Ser. No. 06/795,169, filed Nov. 5, 1985, abandoned, which is a continuation of application Ser. No. 06/366,536, filed Apr. 8, 1982, abandoned.

BACKGROUND AND SUMMARY OF THE PRESENT INVENTION

The present invention relates generally to a closet storage arrangement. More particularly, it concerns an upright shoe rack in a closet having at least one clothes hanging bar.

Conventional closet storage arrangements, in even the costliest new housing, serve the builder rather than the occupant. Wooden cleats are fastened to side walls and a back wall of the closet so that a wooden clothes pole, which is laterally suspended across the closet, will be approximately sixty-five inches above the closet floor thereby accommodating the longest garments conventionally made. A wooden shelf is rested on the cleats above the pole. Since wood will sag under any kind of load in approximately a thirty inch span, a bracket is attached to the rear wall at intervals to support both the pole and the shelf. The whole arrangement is relatively inexpensive to install but results in a large amount of wasted space in a closet at a time when the size of many persons' wardrobes has greatly expanded.

More and more people are finding that the storage space in a conventional closet is inadequate for their needs since more garment hanging space and more shoe storage space is desired to hold larger wardrobes. In a conventional closet, the many pairs of shoes that most people now own are just jumbled in a pile. Thus a convenient shoe storage structure in a closet would be desirable for the large variety of shoes ranging from sneakers to hiking boots that many people own.

Many people also find that it would be useful to have more garment hanging space than a conventional closet provides. Also, it is sometimes difficult to slide the garment hangers on a wooden clothes pole because the garment hangers bind on the pole. Thus a closet with more garment hanging space and a clothes pole or hang bar with a smoother surface would be desirable.

To make a more effective use of existing closet space the garment hanging space may be expanded through the use of more clothes poles or bars. A kit having a plurality of supportive bars, intersection connectors holding together two mutually perpendicular supportive bars and end connectors which may be mounted to a vertical or horizontal surface is known to the prior art. Each of the supporting bars includes an inner cylindrical tube which is telescopically received in an outer cylindrical tube. A plurality of horizontal clothes bars are connected at one end to a side wall of the closet and are expanded until the other ends of the bars either meet the other end of the closet or a vertically aligned bar. The vertical bar, which is secured between a floor of the closet and a closet shelf by end connectors is attached to these horizontal bars by the intersection connectors. It would be desirable, however, to have a closet arrangement that does not need a complex assortments of intersection connectors, end connectors and telescoping bars. It would also be desirable to have a closet arrangement providing for vertical storage of a plurality of pairs of shoes.

A closet arrangement provided with a plurality of U-shaped brackets providing garment support and support for horizontal shelves is also known to the prior art. Each U-shaped bracket has an upper and a lower hollow tubular leg which may be telescopically adjustable. The ends of the bracket are fixed to a side wall of the closet. Each of the brackets is supported by a vertical post which is secured to the floor of the closet. Interposed between the two brackets may be a plurality of spacers which can serve as supports for a plurality of shelves with the spacers being secured at each end to a respective bracket. It would be desirable, however, to have a closet arrangement that does not need a complex assortment of brackets, spacers, vertical supports, shelving and connectors in a closet arrangement. It would also be useful to provide a closet arrangement that substantially increases the lateral hangbar space available for hanging clothes over that available in a conventional closet.

Accordingly, a closet storage arrangement according to the present invention includes a shoe case having two substantially vertical plane side walls in spaced parallel relation resting on a closet floor. A plurality of support members connect the two side walls and define a plurality of tiers for storing shoes between the side walls. Each tier includes a rear support member, and two forward support members both spaced vertically below the rear support member, the two forward support members being horizontally spaced. At least one bar for supporting clothes on hangers may also be provided with the bar extending between and secured at each end to a stilt member which rests on the closet floor and is braced against a back wall of the closet. A top shelf is normally supported above the stilt members. A peg rack may also be provided for hanging articles with the peg rack being secured to either a closet wall or a closet door. The peg rack includes a plurality of individually removable peg members with each peg member fitting into an aperture in a substantially horizontally extending board. Each peg is selectively removable to allow more room for an item hung from a remaining peg.

BRIEF DESCRIPTION OF THE DRAWINGS

A preferred embodiment of a closet storage arrangement according to the present invention is described with reference to the accompanying drawings wherein like members bear like reference numerals and wherein.

DETAILED DESCRIPTION OF THE PREFERRED EMBODIMENT

Figure 1:
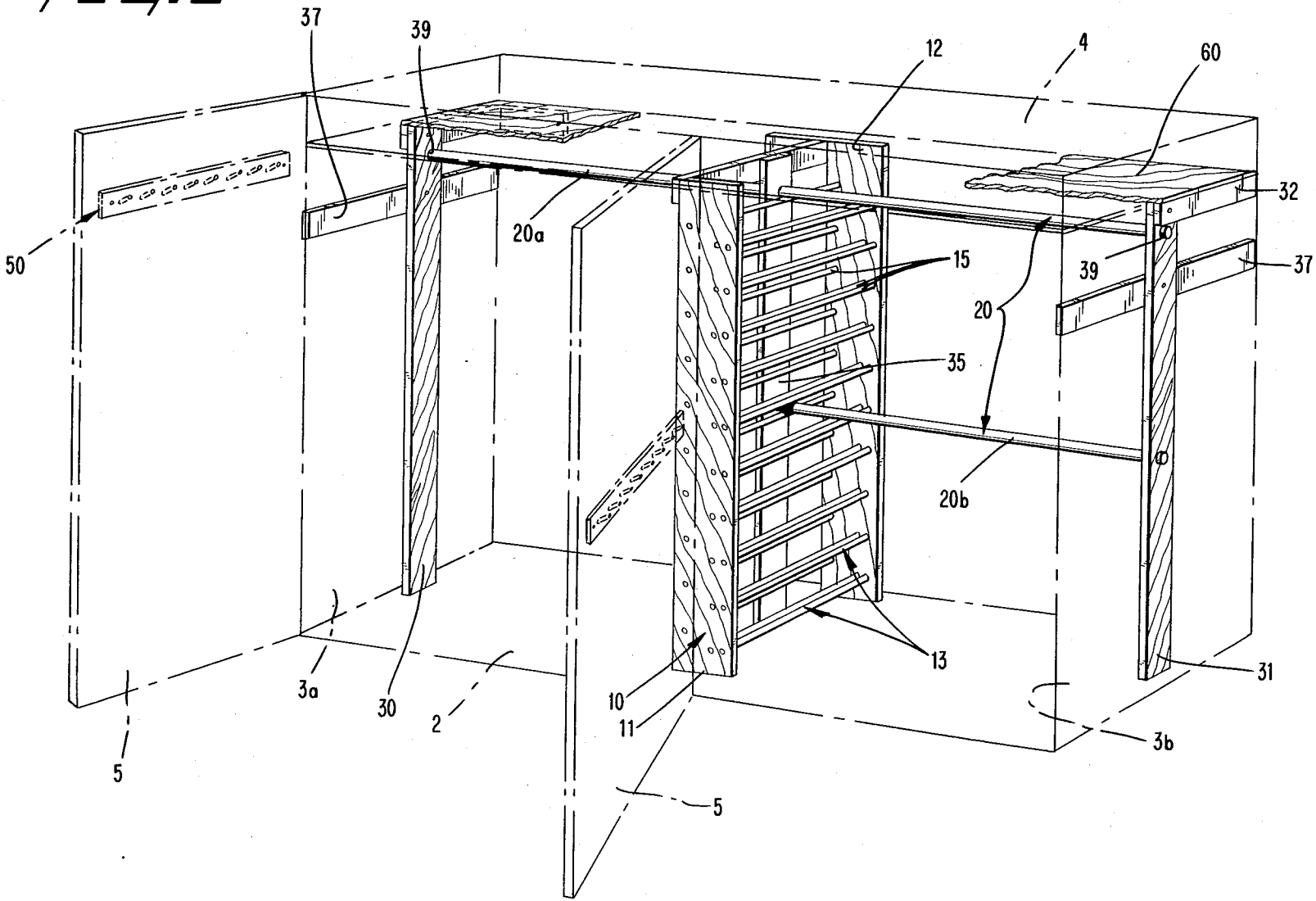
FIG. 1 is a perspective view of the closet storage arrangement according to the present invention.

With reference to FIG. 1, a preferred embodiment of a closet storage arrangement according to the present invention includes a closet having a floor 2, two side walls 3*a*, 3*b*, a rear wall 4 and two doors 5 with a shoe rack 10 disposed therein. Of course, the closet may have any number of doors 5 or no doors at all. The shoe rack 10 has a front side wall 11 and a rear side wall 12 with a plurality of tiers 13 for storing shoes extending therebetween. With the present arrangement, a person is able to store a large number of shoes in neat vertically spaced rows in the shoe rack 10 rather than in a pile on the floor as in a conventional closet.

Two substantially horizontal bars 20 from which clothes hangers (not illustrated) may be suspended may also be disposed in the closet instead of a conventional closet hang bar. Of the two bars 20, a top bar 20*a* extends the width of the closet and a bottom bar 20*b* extends approximately half the width of the closet. One is thus able to store a substantially greater number of clothes on the two bars 20 than would be possible in a conventional closet. A top shelf 60 is normally disposed above the two bars 20.

Each tier 13 of the plurality of tiers of the shoe rack 10 is defined by a plurality of support members 15. The support members 15 which may be rods, dowels, pins or pegs are fitted into the side walls 11, 12 of the shoe rack 10 with a tight fit. In this way the entire shoe rack 10 is held together by the snug fit of the support members 15 in the side walls of the shoe rack. For the sake of convenience, the support members 15 will be termed dowels since the support members are preferably round in cross-section and fit tightly, e.g. by a press-fit, into corresponding holes in the two shoe case side walls 11, 12 to align and fasten the two side walls with respect to each other. The dowels 15 may also be glued in place or similarly fastened between the side walls 11, 12 of the closet. Of course the dowels 15 may be square or have another type of cross-section if so desired. Since a snug fit holds together the entire shoe case 10, there is no need for a top wall or member (not illustrated) connecting the two side walls 11, 12. Of course, a top wall could be provided if desired. The shoe case side walls 11, 12 and dowels 13 are preferably made from wood because wood is inexpensive but may be made from any other suitable material.

Because there are only dowels 15 extending between the side walls 11, 12 instead of shelves, the entire shoe case 10 is open permitting all the shoes to be visible from the top tier to the bottom tier. Since the shoe case 10 is open, the hang bars 20 can also extend through the case. Therefore, the shoe rack 10 may be installed towards the doors 5 of the closet, towards the back wall 4, next to either side wall 3*a*, 3*b* of the closet or in the middle of the closet (as illustrated in FIG. 1). The location of the shoe rack 10 is normally dictated by the available space in the closet and the wishes of the user of the closet.

With a forward facing shoe rack, in order to accommodate thirty pairs of shoes approximately twenty-one inches of lateral inner space is required thus necessitating a shoe rack of approximately twenty-three inches of overall width in a shoe case approximately seventy-six to eighty one inches high, if three pairs of shoes are placed side by side on each of ten levels or tiers. By the use of the present shoe rack 10 placed sideways in the closet, however, the same number of shoes can be stored in only approximately nine inches of lateral space, if the shoes are ten inches long as would be the case for most women's shoes. For men's shoes, only approximately eleven inches of lateral space would be required if the shoes were twelve inches long.

Of course more than one shoe case 10 may be installed in a closet as dictated by the particular size of the closet and the requirements of the person or persons using the closet. For example in a very long closet, such as would be used in a master bedroom, two shoe cases 10 may be installed side by side (not illustrated), one for the husband and one for the wife, with each case holding approximately thirty pairs of shoes. Normally, to hold sixty pairs of shoes would require over forty inches of lateral space. Such lateral space is then, of course, not available for hanging clothes. With a side by side placement of the shoe cases 10 of the present invention, however, the same storage of sixty pairs of shoes can be achieved in only approximately twenty inches of lateral space thus leaving more lateral space for hanging clothing.

Since most clothing hung on a hang bar does not extend the full depth of a conventional closet, normally twenty three inches, a front pair of shoes in every one of the ten tiers 13 may be reachable without touching any clothing at all. Most clothing will fall within the plane of a standard hanger (not illustrated) which is approximately sixteen inches wide and some garments, such as folded slacks, may be even narrower. Other garments, however, such as suit jackets, quilted housecoats, down filled jackets, etc. do need the full twenty three inches of closet depth. But because the ten tiers 13 are open dowel work and not closed shelving, all the shoes stored are visible down through the rack.

Figure 2:
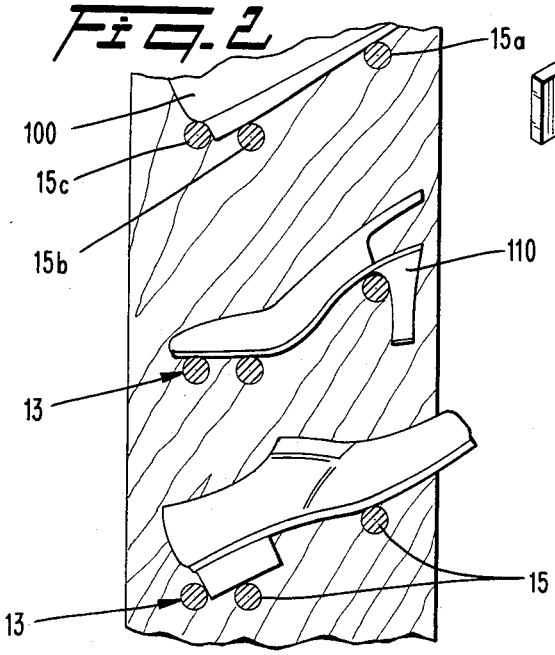
FIG. 2 is an enlarged perspective view of a dowel arrangement of a shoe rack portion of the storage arrangement of FIG. 1.

With reference now to FIG. 2 each tier 13 of the shoe rack or case 10 has three dowels 15. A back dowel member 15*a* is disposed rearwardly, preferably by approximately three to five inches, and upwardly, preferably by approximately two and one-half inches on center, of two front dowels, a front first dowel member 15*b* and a front second dowel member 15*c*. These latter two dowel members 15*b*, 15*c* are parallel to each other and are horizontally spaced from each other, preferably by approximately one and one-half inches. Of course, any other dowel spacing arrangement will suffice as long as the three dowel members 15*a*, 15*b*, 15*c* are so spaced from each other that they cooperate to hold a shoe well balanced on the tier 13.

Previously, tennis shoes 100 could not be stored in a closet shoe case having a dowel arrangement for holding shoes at an angle because the tennis shoe, having no distinct or "built up" heel for hooking on a back dowel, would slide off the dowels. In the present invention, on the other hand, the rear dowel 15*a* can be used to support a front sole portion of the tennis shoe 100 and the front second dowel member 15*b* supports a heel bottom portion of the tennis shoe so that the tennis shoe is held at an angle in the shoe case 10. The front first dowel member 15*c* supports a heel back portion of the tennis shoe and prevents it from sliding off the other dowels. The gap between the two front dowel members 15*b*, 15*c* is generous enough to catch low or no heel shoes without being so wide that slippers fall through or heels catch or snag. Gravity thus holds the tennis shoe 100 securely in position in the shoe case 10. Also, the lateral shape required to store shoes is reduced by holding the shoes at an angle. For example, a twelve inch long pair of tennis shoes may be accommodated in only approximately eleven inches of lateral space in the closet thereby allowing more storage space for clothing.

In the instance of a woman's high-heeled shoe 110, a heel portion of the shoe can be hooked over the rear dowel member 15*a* while the sole of the shoe may rest on both of the front dowel members 15*b*, 15*c*. The present arrangement permits high heeled shoes 110 to be held securely, graspable from the toe. But it also permits low heeled shoes and shoes with no distinct heel, including wedgies, slippers and sneakers to be securely held and be graspable from the heel.

Of course, the shoe case or rack 10 of the present invention will accommodate both mens and womens shoes as desired. Normally, the overall width of the shoe case 10 would be approximately twenty three inches but it may be less as required and may also be as great as forty eight inches, if closet depth permits, since the shoe case normally needs no glueing to be stable. Since a pair of shoes is generally about seven inches wide, three pairs of shoes may easily be stored on the twenty three inch wide shoe case. The width of the shoe case side walls 11, 12 may range between approximately six inches, for women's shoes, to approximately nine inches, for men's shoes. The back or rear dowel 15*a* needs to be placed so as to support a sole of a low heeled shoe at approximately its midpoint rather than at its toe. Therefore the side walls of the shoe case for women's shoes, which are generally about ten inches long, may be considerably shorter than ten inches, i.e., approximately six inches.

The shoe case 10 may be easily disassembled and the dowels trimmed for use in a closet less deep than the standard closet if desired. Such a situation may be encountered for example, if an irregular space not originally intended for closet use is used as a closet. Finally, the shoe case 10 of the present invention may be made very economically because even the finest hardwood dowels cost less than the most inexpensive particle board shelving heretofore used for shoe cases.

With reference again to FIG. 1, the hangbars 20 are fitted into respective vertical support members 30, 31, 35 in a snug manner by the use of a thin and flexible end cap (not illustrated) on each end of each hangbar 20. The end caps are preferably made from a plastic or a similar material and serve the additional function of sealing the cut ends of the hangbars 20. The hangbars 20 are preferably made from a strong lightweight material having a smooth surface. In one preferred embodiment, the hangbars 20 are made from a one and one-sixteenth inch O.D. polished chrome-plated steel tube. Clothes hangers slide more easily on the hang bar 20 of the present invention than on the wooden clothes pole of the conventional closet thus making it easier to select a particular article of clothing. Since clothes hangers slide so easily on the smooth surface of the hang bar 20 of the present invention, the shoes in a rear portion of the shoe rack 10 are also easily reached. In order to further improve the sliding action of the clothes hangers, a thin layer of paste wax may be applied to the surface of the hang bar 20.

For the sake of convenience, the vertical support members 30, 31, 35, which may be termed poles, posts or stilts, will be termed stilts because they are elongated preferably rectangular members used for support. Of course the support members or stilts 30, 31, 35 could also be round or have any other desired cross-section. The top hang bar 20*a* is fitted at its ends into respective apertures 39 in the first and second end stilts 30, 31 which may in turn be secured to respective side walls 3*a*, 3*b* of the closet. Preferably, the apertures 39 are located approximately two inches below the top of the stilts 30, 31, 35 so that ample clearance is provided to lift a clothes hanger off the upper hangbar 20*a* even if the top shelf 60 is placed above the stilts. The lower hang bar 20*b* is fitted on a first end into the second end stilt 31 but is fitted on its second end into an intermediate stilt 35 which rests on the floor of the closet and through which the upper hang bar 20*a* also passes. Of course, if the closet is narrow enough and no lower hang bar 20*b* is desired, the intermediate stilt 35 may not be necessary.

Figure 3:
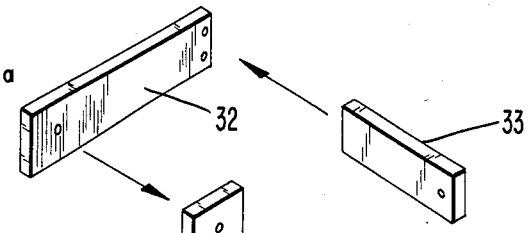
FIG. 3 is an enlarged exploded view of a stilt portion of the storage arrangement of FIG. 1.
Figure 3:
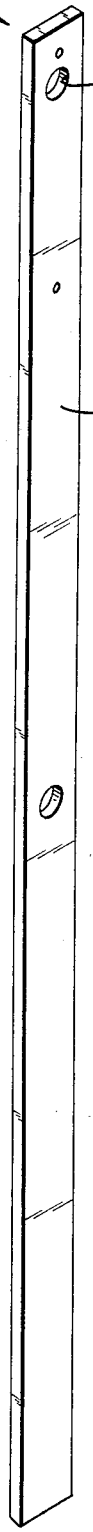

A stabilizing arrangement is provided for each end stilt 30, 31. Since both end stilts 30, 31 are identical except for their mirror-image position in the closet and the support of the lower hang bar 20*b* by the second end stilt 31 but not the first end stilt 30, only the first end stilt 30 will be discussed in detail. With reference now to FIG. 3, the stabilizing arrangement or tee-arm includes a cross piece 32 and a rear piece 33. The stilt 30, the cross-piece 32 and the end piece 33 may be made from any suitable material but are preferably made of a strip of wood which may be one and one half to two inches wide by three-quarter inches thick. These members are preferably made of wood because wood is an inexpensive material which may be drilled and cut without special tools. Normally, the intermediate stilt 35 is also provided with a stabilizing arrangement. The stabilizing arrangement for the center stilt 35, is not crucial to the functioning of the closet storage arrangement, but is useful to help stabilize the center stilt and, perhaps more importantly, to help support the top shelf.

The length of the stilt 30 would depend upon the length of the garments to be hung, the height of the closet space and the height of the hang bars 20 from the floor 2 of the closet. A fastener (not illustrated) would normally attach the stilt 30 to an existing wall cleat 37 (See FIG. 1) in the closet. Normally, the stilt 30 is attached to the cleat 37 of the closet so that a central line of the hang bar or hang bars 20 supported by the stilt is a proper distance from the back wall 4. Approximately eleven or twelve inches from the back wall 4 is the normal distance but the distance is capable of variation as required in a particular closet.

Preferably, the cross piece 32 is approximately twelve to fifteen inches long, the width of the existing top shelf. The stilt 30 is fastened to the cross piece 32 in any conventional fashion such as by a screw (not illustrated). If the closet does not have an existing cleat 37 or if additional support for the stilt 30 is desired, the cross piece 32 may also be fastened to the left side wall 3*a* of the closet by any conventional fasteners.

The back member or back brace 33 may be of any suitable length to provide a good bracing surface against the back wall 4 and is in a preferred embodiment four inches long. To provide a strong connection, the back brace 33 is butted to an inside end of the cross piece 32 and may be secured in position by any conventional fastener, for example, resin coated nails. Any normally used fastener, for example a screw (not illustrated), attaches the back member 33 to the back wall 4.

Unlike conventional closet arrangements which transfer the load imposed on a hang bar to a side wall of the closet, the stilt 30 of the present invention transfers the load from the hang bars 20 vertically to the floor 2 of the closet. Attaching the stilt 30 to the cleat 37 and hence to the a side wall 3*a*, 3*b*, by a fastener through the stilt, or to the back wall 4 through the cross piece 32 and back member 33 is done mainly to prevent the stilt from swaying sideways and is not done to force the side wall or back wall to bear the load imposed on the hangbars 20 by the clothing supported therefrom. Since the hang bars 20 have a snug fit in their respective apertures 39 in the stilts 30, 31, 35, the vertical loading of the weight suspended from the hang bars 20 provides that the entire stilt arrangement 30, 31, 32, 33, 35 is self stabilizing.

That is, the heavier the garment load on the hang bars 20, the sturdier becomes the structure.

The stilt stabilizing arrangement of the present invention also makes the closet storage arrangement portable. That is, the stilt structure of the present invention may be moved to a larger closet without having to lengthen the hang bars 20 to extend the stilts 30, 31 to the sidewalls of the larger closet because the stilt stabilizing arrangement may be fastened anywhere along a closet rear wall. Thus both stilts 30, 31 do not have to be attached to a respective side wall of the closet. Conventionally, one stilt would be fastened to a closet side wall but the other stilt would only be fastened to the closet rear wall by the stilt stabilizing arrangement. The closet storage arrangement of the present invention may also be installed in a smaller closet but only when the overall length of the longer hang bar 20*a* is decreased. This may be done by utilizing a pipe cutter (not illustrated) to trim the length of the upper hang bar 20*a*.

Normally, a closet is high enough to retain the top shelf 60 from the conventional closet arrangement. After the shoe rack 10 and stilt arrangement are installed, the top shelf 60 can be re-installed in the closet. If re-installation is desired, the top shelf 60 is placed above and may be secured to the cross pieces 32 and back braces 33 of the stilt-stabilizing arrangements to provide even more storage space. The stabilizing arrangements or tee-arms serve as support base for the top shelf 60. Also, if the middle stilt 35 or its stabilizing arrangement is attached to the top shelf 60, the middle stilt can serve to support the tap shelf so that it doesn't sag. At the same time, the top shelf 60 can further brace the middle stilt 35, as well as both end stilts 30, 31.

Figure 4:
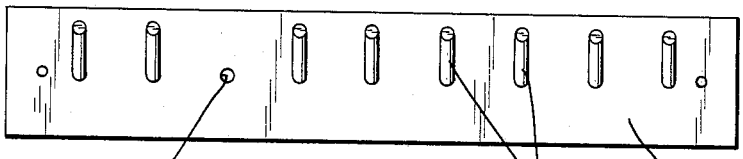
FIG. 4 is an enlarged perspective view of a peg rack portion of the storage arrangement of FIG. 1.
Figure 5:
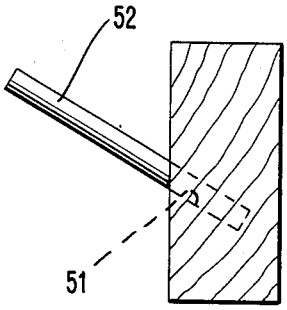
FIG. 5 is an enlarged side view of the peg rack of FIG. 4.

With reference again to FIG. 1, the closet arrangement of the present invention may also include a horizontal peg support or peg bar 50 fastened, for example, to the doors 5 of the closet. With reference now to FIG. 4 the peg bar 50 of the present invention may be made from any suitable conventional material such as, for example, a two inch wide rectangular wood board into which a plurality of angled apertures 51 are drilled (see FIG. 5). A peg or pin 52 may be inserted in each one of the apertures 51. Ideally, the peg bar 50 may be mounted on an inside surface of a closet door (see FIG. 1). But, the peg bar 50 can also be mounted on exterior walls of the closet, on bathroom doors or walls or any other vertical surface. Since the peg bars 50 are preferably made of wood, they may be cut to any desired length.

With regard to the apertures 51, these may be drilled into the peg bar 50 with any desired spacing and at any suitable angle. In one preferred embodiment, one aperture occurs every one and one-half inches on center at an approximately thirty degree angle. These apertures 51 are designed to hold pins 52 of approximately three-eights or five sixteenths of an inch in diameter and approximately two and one-half inches in length. Such pins 52, which are preferably round and made of wood so that they are inexpensive, are useful for hanging ties, belts, scarves, small handbags, umbrellas, etc. from the peg bar 50. Of course the peg bars 50 may be used to hold clothing as well and the pins could have any desired cross-section.

The pins 52 are not secured to the peg bar 50 but may instead be removed when desired. For example, if the user wishes to hang a belt having a very large belt buckle (not illustrated) the pins 52 on either side of the dowel pin on which the belt is hung are removed (one dowel pin 52 has been removed in FIG. 4) so that no obstruction is provided to the belt buckle. Similarly, bulky garments, umbrellas with large handles, or other objects may be hung from one pin 52 while one or more other pins are removed. Although the pins 52 are not secured to the peg bar 50, they do not fall out because the apertures 51 are drilled at an angle and the force of gravity holds the pins in place.

Any conventional fasteners, for example screws (not illustrated) may fasten the peg bar 50 to the door 5. Preferably, the peg bar 50 is positioned substantially horizontally on the door 5 but may be placed at an angle to the horizontal if desired. In such a case, the orientation of the apertures 51 may have to be changed so that the dowel pins 52 not fall out of the apertures.

To design, construct and install the storage arrangement of the present invention only takes a few hours. The size of the existing closet, the lengths and amounts of clothing involved, and the height of the person using the closet are measured. After agreement on the version of the closet storage arrangement most appropriate, the various components are prepared. The stilts 30, 31, 35 of the present invention are cut to the desired length and apertures 39 are drilled in each of the stilts. The stilt stabilizing arrangement including the cross piece 32 and the back member 33 are then cut to the desired length and fastened to each other and to a respective end stilt 30, 31.

The shoe rack 10 is prepared by selecting two side walls 11, 12 of approximately the same length as the stilts 30, 31, 35. Then a plurality of dowels 15 are fitted into apertures drilled in the shoe rack side walls 11, 12 to provide as many tiers 13 as are desired. The maximum length of the dowels would depend on the depth of the closet. The hang bars 20 are cut to the desired length and are capped on each end. Subsequently, all the components are carried to the closet site and the conversion of the closet can take place, normally in less than an hour.

The top shelf of a conventional closet is removed after which the existing clothes pole or clothing bar is also removed. Then one of the stilts, for example the second end stilt 31, is fastened to the closet wall cleat 37. One end of each of the upper and lower hang bars 20*a*, 20*b* are fitted in the stilt which has been fastened to the wall cleat 37. The shoe rack 10 is then worked into place so that both hang bars 20*a*, 20*b* extend through the shoe rack between its side walls 11, 12. If a central stilt 35 is used, it is worked into the appropriate position. Then the first end stilt 30 is worked into position against the wall cleat 37 so that the upper hang bar 20*a* is fitted into the first end stilt. Subsequently the first end stilt 30 is fastened to the wall cleat 37. Thereafter the end pieces 33 are fastened to the rear wall 4 of the closet. If the first end stilt 30 does not contact the wall cleat 37, as would be the case if the closet storage arrangement were moved from a smaller closet to a larger closet, then only the end piece 33 on that side of the closet would stabilize the first end stilt 31. Subsequently, one or more peg bars 50 may be fastened to the doors 5 of the closet.

If a particular closet is high enough, the top shelf 60 from the conventional closet arrangement is re-installed. In such a situation, the top shelf is placed above and may be secured to the cross pieces 32 and back braces 33 of the present invention to provide even more storage space. Storing the top shelf 60 of a conventional closet arrangement is often difficult, although important if the closet is eventually to be restored to its original form, so it is advantageous to place the top shelf above the stilt arrangement of the present invention. Normally, the top shelf 60 will be located approximately nine to eighteen inches above its previous location in the closet depending on the height of the stilts 30, 31, 35.

The principles, preferred embodiments and modes of operation of the present invention have been described in the foregoing specification. The invention which is intended to be protected herein, should not, however, be construed as limited to the particular forms disclosed, as these are to be regarded as illustrative rather than restrictive. Variations and changes may be made by those skilled in the art without departing from the spirit of the present invention. Accordingly, it is expressly intended that all such variations and changes which fall within the spirit and scope of the present invention as defined by the claims be embraced thereby.

What is claimed is:

1. A closet storage arrangement comprising:

a substantially horizontal hang bar for hanging clothes extending between first and second walls of a closet;

first and second vertical support members resting on a floor of said closet, said hang bar extending between and secured at each end to a respective one of said first and second vertical support members, wherein a vertical load imposed on said hang bar by clothing hung therefrom is imposed by said hang bar on said vertical support members and thus on said floor of said closet; and stabilizing means for stabilizing said two vertical support members against a third wall of said closet, said stabilizing means including:

two cross-pieces, one secured to each of said vertical support members; and two back braces, one secured to each of said cross-pieces and also secured to a third wall of said closet, each of said cross-pieces cooperating with one of said back braces to brace one of said vertical support members in said closet and also to correctly position said vertical support members in said closet.

2. The closet storage arrangement of claim 1, further comprising a shelf supported by said vertical support members and said stabilizing means.

3. A closet storage arrangement for increasing a closet's storage capacity, the closet having a floor, two side walls, a back wall extending between and normal to the two side walls and at least one door member, comprising:

a shoe case for storing shoes in the closet, including;

two substantially vertical planar side walls in spaced parallel relation, said two side walls resting on the closet floor, and a plurality of horizontal support members, extending between and secured to said two shoe case side walls, defining a plurality of vertically spaced tiers for storing shoes in said shoe case, each tier including a rear support member, a forward first support member and a forward second support member and wherein said shoe case faces sideways in the closet to minimize the lateral clothes hanging space made unavailable for hanging clothes by said shoe case;

at least one hang bar for supporting clothes on hangers extending substantially horizontally transversely through said shoe case;

two end vertical support members resting on the closet floor, said at least one hang bar extending between and secured at each end to one of said two end vertical support members; and stabilizing means for stabilizing each of said two end vertical support members against the back wall of the closet, said stabilizing means including a cross-piece secured to a respective end vertical support member and a back brace secured to the cross-piece and also secured to the back wall of the closet wherein a vertical load imposed on said at least one hang bar by clothing hung therefrom is imposed by said hang bar on said vertical support members and thus on the floor of the closet.

4. The closet storage arrangement of claim 3, and further comprising:

a central vertical support member resting on the closet floor, wherein two vertically spaced hang bars are provided, an upper bar extending between said shoe case side walls above an uppermost tier, a lower bar extending between said shoe case side walls between two of said plurality of vertically spaced tiers, said lower bar extending between and secured at one end to an end vertical support member and at a second end secured to said central vertical support member, said upper bar also passing through said central vertical support member; and a shelf supported by said vertical support members and said cross-pieces and back braces.

5. A closet storage arrangement for increasing a closet's storage capacity, the closet having a floor, two side walls, a back wall extending between and normal to the two side walls and at least one door member, comprising:

a shoe case for storing shoes in the closet, including:

two substantially vertical side support units in spaced parallel relation, said two side support units resting on the closet floor, and a plurality of horizontal shoe support members, extending between and secured to said two shoe case side support units, defining a plurality of vertically spaced tiers for storing shoes in said shoe case, each tier including a rear support member, a forward first support member and a forward second support member and wherein said shoe case faces sideways in the closet to minimize the lateral clothes hanging space made unavailable for hanging clothes by said shoe case;

at least one hang bar for supporting clothes on hangers extending substantially horizontally transversely through said shoe case;

two end vertical support members resting on the closet floor such that said shoe case is situated between said end vertical support members, said at least one hang bar extending between and secured at each end to one of said two end vertical support members so that a vertical load imposed on said at least one hang bar by clothing hung therefrom is imposed by said hang bar on said vertical support members and thus on the floor of the closet, and stabilizing means for stabilizing each of said two end vertical support members against a wall of the closet.

6. The closet storage arrangement of claim 5, and further comprising:

a central vertical support member resting on the closet floor, wherein two vertically spaced hang bars are provided, an upper bar extending between said shoe case side support units above an uppermost tier thereof, a lower bar extending between said shoe case side support units between two of said plurality of vertically spaced tiers, said lower bar extending between and secured at one end to an end vertical support member and at a second end secured to said central vertical support member, said upper bar passing through said central vertical support member.

7. The closet storage arrangement of claim 6, and further comprising a shelf supported by said vertical support members.

* * * * *